US005413080A

United States Patent [19]

Laufer

[11] Patent Number: 5,413,080

[45] Date of Patent: May 9, 1995

[54] FUEL INJECTION PUMP

[75] Inventor: Helmut Laufer, Gerlingen, Germany

[73] Assignee: Robert Bosch GmbH, Stuttgart, Germany

[21] Appl. No.: 225,113

[22] Filed: Apr. 8, 1994

[30] Foreign Application Priority Data

Apr. 8, 1993 [DE] Germany ..... 43 11 672.8

[51] Int. Cl.[6] ..... F02D 1/18; F02M 41/12

[52] U.S. Cl. ..... 123/502

[58] Field of Search ..... 123/179.17, 502

[56] References Cited

U.S. PATENT DOCUMENTS

| | | | |
|---|---|---|---|
| 4,489,698 | 12/1984 | Höfer et al. | 123/179.17 |
| 4,502,449 | 3/1985 | Laufer | 123/502 |
| 4,932,385 | 6/1990 | Khorreck | 123/502 |
| 5,033,441 | 7/1991 | Hain | 123/179.17 |
| 5,138,999 | 8/1992 | Tomsett | 123/502 |
| 5,180,290 | 1/1993 | Green | 123/502 |
| 5,188,083 | 2/1993 | Reisser et al. | 123/502 |
| 5,243,943 | 9/1993 | Bofinger et al. | 123/502 |

*Primary Examiner*—Henry C. Yuen
*Assistant Examiner*—Thomas N. Moulis
*Attorney, Agent, or Firm*—Edwin E. Greigg; Ronald E. Greigg

[57] ABSTRACT

A control device for varying the supply onset of a fuel injection pump, in which the supply rate at the lower full-load point is increased without overloading the pump at the rated capacity point. A control of this kind is effected by the use of a deflection piston as well as by use of a prestressed check valve. Regulation serving the same purpose can be achieved with the aid of an element pressure sensor and two magnet valves. The control device is intended for use in an internal combustion engine.

20 Claims, 4 Drawing Sheets

FUEL INJECTION PUMP

BACKGROUND OF THE INVENTION

The invention is based on a fuel injection pump as defined hereinafter. A fuel injection pump of this kind is already known from German Patent Application 29 23 445 A.

In fuel injection pumps, the following problem arises: If the pumping rate of the fuel injection pump is optimized to the rated output point of the internal combustion engine at maximum load and maximum rpm, so that the maximum allowable pressure in the pump work chamber of the fuel injection pump occurs, then this pressure is as a rule overly low, given a low rpm of the fuel injection pump or of the associated engine, at the lower full-load point, for the sake of the quality of fuel introduction into the engine combustion chambers through injection valves. If the pumping rate is raised in this range, then although the pressure at this lower full-load point then desirably rises, nevertheless, at the rated capacity point the fuel injection pump is overloaded. Accordingly, if the pressure at the lower full-load point is raised, then provision must be made so that the pump will not be overloaded at the rated power point.

The aforementioned known fuel injection pump discloses a device with which the pumping rate is reduced in the lower load/rpm range as a function of the feeding in full-load operation and at high rpm, in order to achieve noise-abating long injection times or low injection rates with respect to the injection quantity. Then the work chamber upstream of the adjusting piston is supplied continuously with pressure fluid, brought to an rpm-dependent pressure, from a pressure fluid source for the sake of rpm-dependent adjustment of the adjusting piston and hence of the onset of high-pressure pumping by the pump piston, and the withdrawal device is put into operative connection with the work chamber upstream of the adjusting piston as a function of the rpm.

OBJECT AND SUMMARY OF THE INVENTION

The fuel injection pump according to the invention has the advantage over the prior art that the pressure in the work chamber in the low rpm/load range attains a desired high injection pressure, without the fuel injection pump being overloaded by overly high pressures in the high rpm/load range of the pump.

An advantageous embodiment of the invention is set forth by an embodiment of the fuel injection pump in which, in a simple way, beyond a predetermined load/rpm point, the pumping rate of the pumping piston is reduced over a predetermined rotary angle range. The result is a shaping of the course of the injection pressure that is controlled by the pressure in the pump work chamber, or by the pressure generated by it in the work chamber upstream of the adjusting piston. The control of the injection rate or of the pressure in the pump work chamber for an operating range sought is oriented to the pump work chamber pressure required for injection. A space-saving embodiment is attained; with which, not only can the pressure in the pump work chamber be varied in the region of its maximum pressure, but the effects attained in accordance with the invention can also be achieved.

Also advantageously, the relief valve can also serve as a withdrawal device, by being opened at least intermittently from the time of the high-pressure pumping stroke of the pump piston, or after the onset thereof. Triggering this valve can advantageously be controlled by a sensor that detects the pressure in the pump work chamber or by means of an injection duration control that acts directly upon the pressure in the pump work chamber.

In another advantageous feature, the pressure in the work chamber upstream of the adjusting piston is controlled by an electrically controlled valve that is triggered in clocked fashion, specifically in such a way that its opening time is essentially complementary to the opening times of the relief valve. It is thus assured with certainty that even after a prior withdrawal of fuel from the work chamber during the preceding high-pressure pumping stroke of the pump piston, the work chamber can be rapidly filled with fuel for the next high-pressure pumping stroke of the pump piston in order to establish the requisite high-pressure pumping stroke onset.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
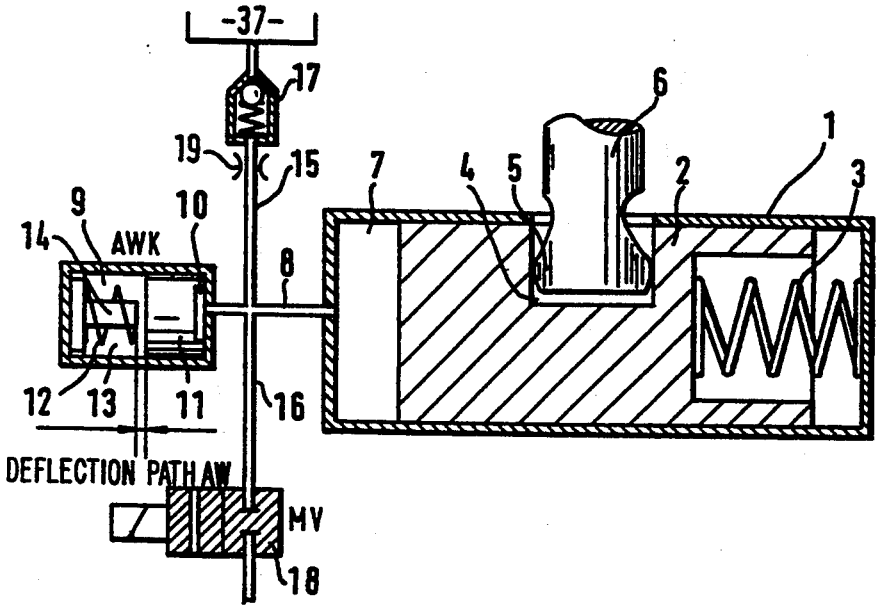
FIG. 1 shows a first embodiment of the control device with a separate deflection piston.

FIG. 1 shows a cylinder 1, in which an adjusting piston 2 is movable counter to the force of a spring 3. The adjusting piston 2 has a recess 4, engaged by a free end 5 of a bolt 6. A work chamber 7 of the cylinder 1 opposite the spring 3 is connected via a line 8 to an additional cylinder, specifically to its work chamber 10. Disposed in the additional cylinder 9 is a deflection piston 11, which as a movable wall defines the work chamber 10. On the back side of the deflection piston 11, a stop 14 is placed in a chamber 13 that receives a prestressed spring 12; the stop 14 limits the travel of the deflection piston 11 to a predetermined stroke (AW). Connected to the line 8 are a pressure fluid inflow line 15, which leads away from a pressure fluid source 37 carrying pressure fluid at elevated pressure, and a pressure fluid outflow line 16, which leads to a relief chamber. An inflow check valve 17 with a throttle 19 is located in the pressure fluid inflow line 15, and an electrically controlled valve, in this case a magnet valve 18, that serves to regulate the pressure in the work chamber is disposed in the pressure fluid outflow line 16.

The adjusting piston 2 in this case is the piston, known in fuel injection pumps, of an injection onset adjuster. Depending on the displacement of the adjusting piston, the bolt 6, like the corresponding bolt in a fuel injection pump known from German Patent Application 21 58 689 A, adjusts a roller ring, not shown in this application, which is supported rotatably but in a stationary fashion except for the rotation by the bolt 6 in the housing of the fuel injection pump, and on whose rollers a cam disk rolls with its cams. The cam disk is coupled on the one hand to a drive shaft of the fuel injection pump and on the other to a pump piston, which because of the rotation of the drive shaft together with the cam disk executes a rotating motion and thus serves as a distributor, and at the same time, because of the cam disk rolling on the rollers, executes a reciprocating motion and thus, as a pump piston, executes intake and pumping strokes. As is generally known but not further shown here, the pump piston encloses a pump work chamber, which upon the intake stroke is filled with fuel, and in the pumping stroke pumps fuel at high pressure to one injection valve of the engine at a time. The high-pressure pumping of fuel to the injection valves is determined essentially by the onset of the reciprocating motion of the cam disk along with the pump piston as the cam disk travels over the rollers of the roller ring, and the end of pumping for determining the fuel injection quantity is determined essentially by opening of a relief conduit. The cam disk is kept in contact with the roller ring by a restoring force in the form of restoring springs. This restoring force is also reinforced by the reaction force of the pump piston in its pumping stroke. In the process, via the side of the cams of the cam disks, the roller ring experiences a force in its circumferential direction, and this force is counteracted by the adjusting force of the adjusting piston. As a result of this force exerted from the direction of the pump piston, however, the work chamber 7 undergoes a pressure increase compared with the pressure level previously set in order to adjust the adjusting piston. The degree of this pressure elevation corresponds to the pressure generated in the pump work chamber. The pressure elevation is on the other hand possible only because the check valve 17, which closes toward the pressure fluid source, encloses the pressure fluid volume delivered to the work chamber while the magnet valve is simultaneously closed.

Figure 2:
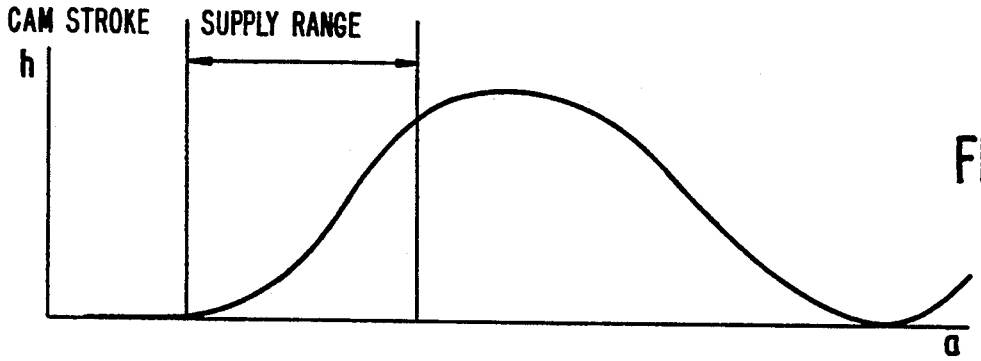
FIG. 2 is a diagram, referring to FIG. 1, of the cam stroke over the rotary angle.

The mode of operation of the apparatus as described thus far, in the embodiment of FIG. 1, is as follows: During the intake strokes of the pump piston, in which no additional force acts upon the adjusting piston that would reinforce the spring 3 in displacing the adjusting piston and would positively displace pressure fluid—in the present case, this is typically fuel drawn from the suction chamber 37 of the fuel injection pump—from the work chamber 7, fuel is supplied to the work chamber via the check valve 17 and the throttle from the pressure fluid source, the suction chamber 37, by way of the pressure fluid inflow line 15. The pressure in the work chamber 7 can assume the level of the pressure in the pressure fluid source, as long as the magnet valve 18 is closed. By actuating this valve 18, the pressure in the work chamber 7 can be varied independently of the pressure in the suction chamber 37; the throttle 19 on the check valve 17 acts as a decoupling throttle. This variation is brought about in each case during the intake stroke by suitable triggering of the magnet valve 18, so that with the onset of the ensuing supply stroke of the pump piston, the pressure in the work chamber that by way of the adjustment of the adjusting piston establishes the correct onset of the high-pressure pumping stroke of the pump piston is established. With the onset of high-pressure pumping, the magnet valve 18 remains closed. With the attendant elevation of the pressure in the work chamber 7, beyond a predetermined pressure level that is determined by the prestressing of the spring 12, the deflection piston 11 can deflect and in so doing withdraw a fragmentary volume from the pump work chamber in accordance with the deflection path AW. This lessens the pressure rise in the work chamber 7, and as the force continues to act upon the adjusting piston 2, this piston, is displaced in the direction of the work chamber 7 and adjusts the roller ring. This means that the reciprocating motion of the cam disk or pump piston takes place in delayed fashion thereafter. The pressure rise in the pump work chamber is also correspondingly less as the course of the pump piston supply stroke continues. FIG. 2 shows the cam elevation curve plotted over the rotary angle $\alpha$. In FIG. 8, the course of the pressure in the pump work chamber, that is, the element pressure is shown, both in the way that it would ensue without the deflection piston 11 as provided for by the invention and in the way that ensues with the action of the deflection piston 11, the latter being represented by a dashed line. In a first embodiment, the prestressing of the spring 12 is selected such that in an upper range of the attainable pressure in the pump work chamber, the deflection motion of the deflection piston begins, thus preventing the establishment of an overly high pressure in the pump work chamber. In a known manner, because of the throttling actions in the high-pressure-side line system, a lower supply rate with a lower final maximum pressure in the pump work chamber is attained at low rpm, and a high pumping supply rate with a correspondingly high final maximum pressure in the pump work chamber is attained at high rpm. This high final maximum pressure arising at high rpm is now reduced by the arrangement according to the invention, with the aid of the deflection piston 11. This effect is especially pronounced at full load as well, because the attainable final maximum pressure also depends on the high-pressure positive-displacement volume of the pump piston. The final maximum pressure attained at full load is higher than at partial load.

Figure 3:
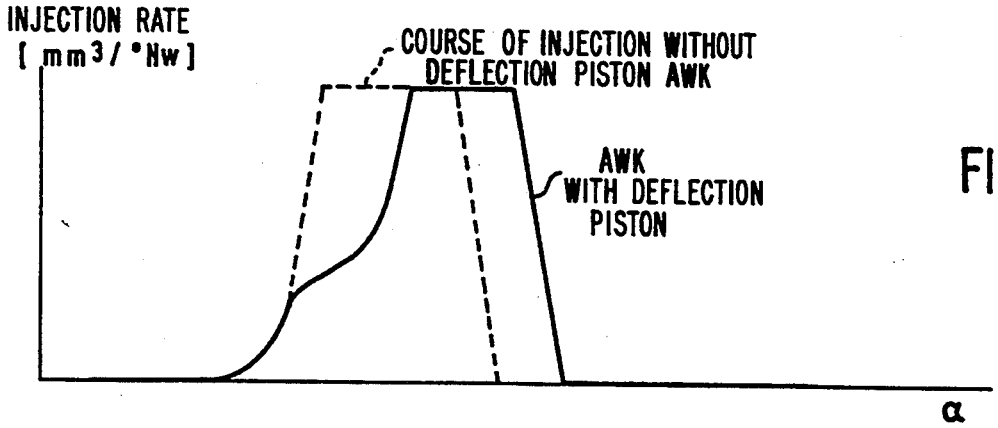
FIG. 3 is a diagram of the course of injection over the rotary angle.

In an alternative embodiment of the exemplary embodiment of the invention of FIG. 1, the stop 14 comes into play. If the prestressing of the prestressed spring 12 is designed to be less, then the deflection piston 11 can begin to deflect already at a lower pressure in the pump work chamber corresponding to a lower injection rate. In that case, at a predetermined load/rpm range, a reduction of the injection rate over a predetermined rotary angle range of the cam stroke can be attained. In this range, the injection rate, in accordance with the course of the injection with the deflection piston 11 (AWK) of the diagram of FIG. 3 would extend with a lesser slope over the rotary angle $\alpha$ until the deflection piston comes to rest on the stop 14. Beyond that point, no further quantity of pressure fluid is drawn from the work chamber 7, so that the pressure rise is now continued in accordance with the predetermined ratio, at the original, unaffected injection rate. With the spring prestressing and the deflection path AW, a predetermined injection course shaping can thus be undertaken. This leads to a reduction in the injection rate, controlled by the pressure in the pump work chamber, that is effective above all for noise abatement in the low load range as well.

At the end of the respective high-pressure pumping stroke of the pump piston, the pressure in the work chamber 7 drops, and the deflection piston 11 can pump the previously withdrawn quantity of fluid back into the work chamber, so that it is again in readiness for the next high-pressure pumping stroke. Any correction in the work chamber pressure that may be necessary then also takes place in this phase, with the aid of the magnet valve 18.

Figure 4:
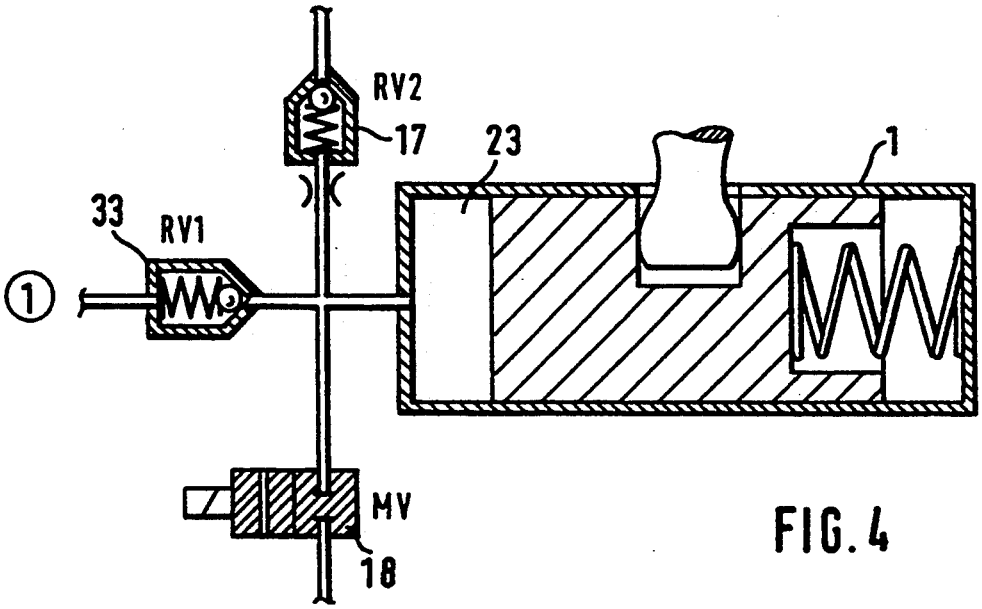
FIG. 4 shows a second embodiment with two check valves.

As FIG. 4 shows, it is also possible, in an embodiment similar to that shown in FIG. 1, to use a prestressed check valve 33 that opens at a preset pressure, rather than a deflection piston. With this kind of check valve 33 as well, the pressure in the work chamber 7 can be varied by withdrawal of fuel, beyond a certain threshold value of the pressure, set by the opening pressure of the check valve 33, in the work chamber 7 or in the pump work chamber. The result is a course of pressure as shown by the dashed line in the lower diagram of FIG. 8*b*. The quantity of fuel withdrawn via the check valve during the pumping stroke of the pump piston must be replenished again during the intake stroke phase of the pump piston, via the check valve 17 and the throttle 19, and with the aid of the magnet valve 18 the pressure in the work chamber 7 must be established, by which the adjusting piston 3 is put in the correct position for the ensuing supply stroke onset.

Figure 5:
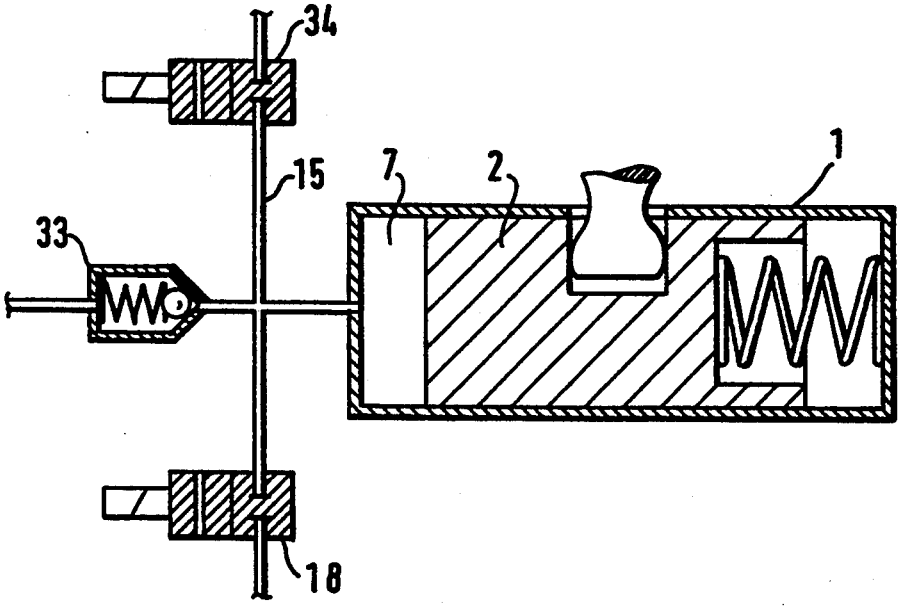
FIG. 5 shows a third embodiment with an outflow check valve and with an additional 2/2-magnet valve.
Figure 6:
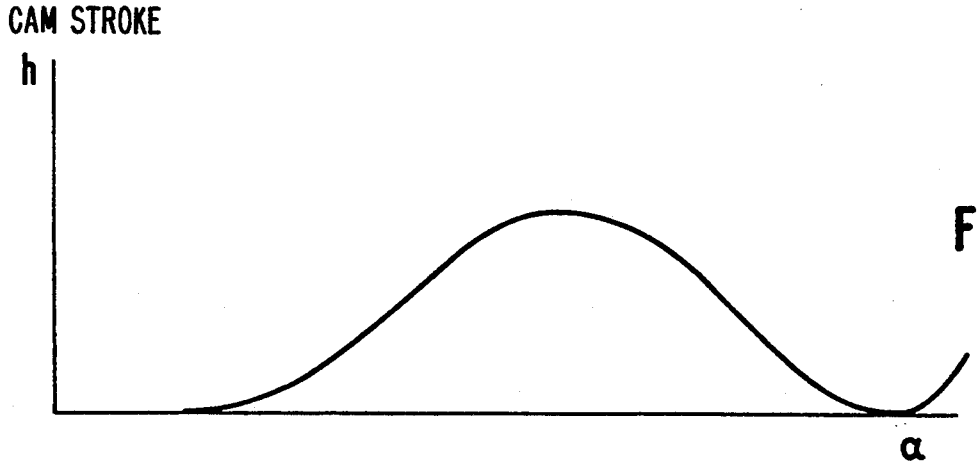
FIG. 6 is a diagram, referring to FIG. 5, showing the cam stroke in operation of the control valve and of the additional magnet valve.

A version that is improved over this is shown in FIGS. 5 and 6. Unlike the construction of FIG. 4, a further 2/2-way magnet valve 34 is inserted here into the pressure fluid inflow line 15, in addition to the magnet valve 18 and instead of the check valve 17 with the throttle. The additional magnet valve 34, via a large opening cross section, enables rapid refilling of the quantity of fluid that escaped via the check valve 33. The two magnet valves 18 and 34 are preferably switched such that the control of the inflow and outflow takes place in the intake stroke phase of the pump piston.

FIG. 6 shows the association of the magnet valve opening phases of the magnet valve 34 (MV 34) and the magnet valve 18 (MV 18) in proportion to the cam elevation curve over the rotary angle $\alpha$. The magnet valves 34 and 18 are triggered in opposite directions, so that for an elevation of pressure in the work chamber 7, the magnet valve 18 is opened for a shorter time than the magnet valve 34. The magnet valve may also be controlled complementary to one another, with a variable pulse-duty factor, and with the variation of the pulse-duty factor the opening time of one valve is varied, at the expense of the other valve.

Figure 7:
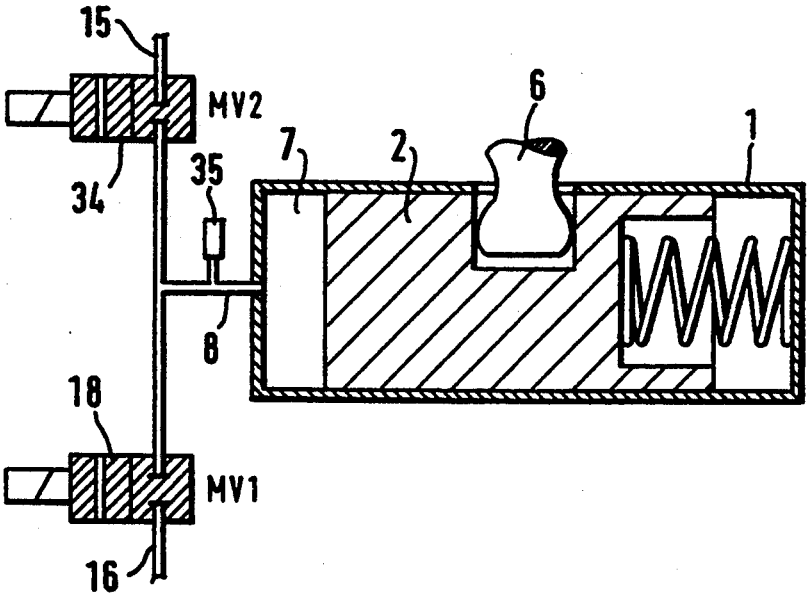
FIG. 7 shows a fourth exemplary embodiment with an additional 2/2-magnet valve.
Figure 8A:
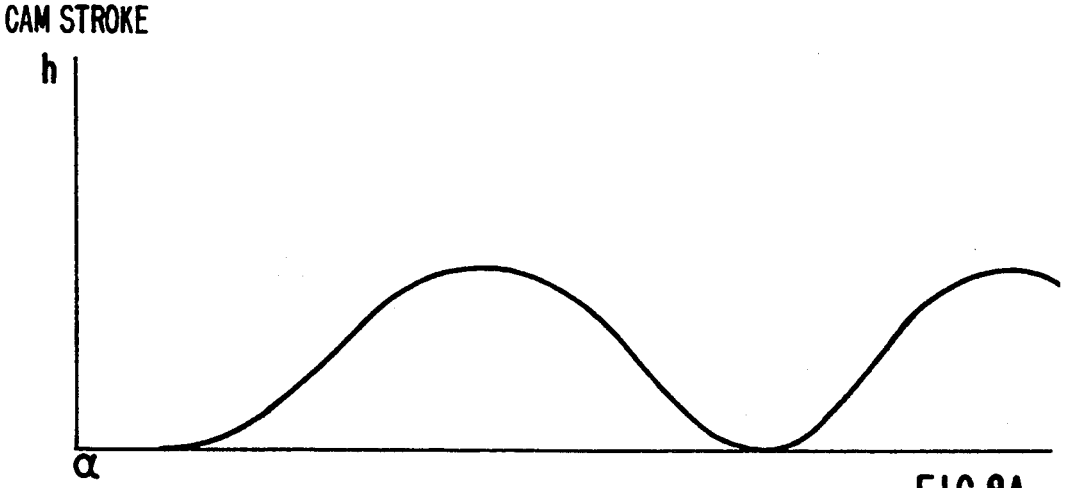
FIG. 8*a* is a diagram, referring to FIG. 7, showing the cam stroke
Figure 8B:
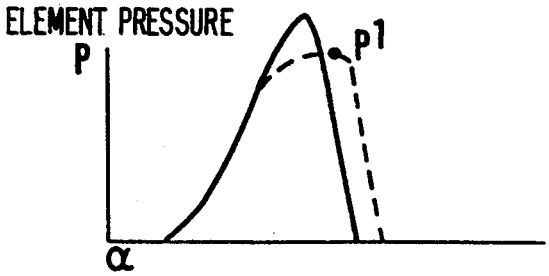
FIG. 8*b* is a diagram illustrating the element pressure in operation of the control valve and of the additional magnet valve.

For highly accurate shaping of the course of pressure and for limiting the maximum final pressure in the pump work chamber, an exemplary embodiment as shown in FIGS. 7 and 8*b* is provided. Those elements that have already been included in the drawing figures described above are identified by the same reference numeral here.

A cylinder 1, in which the adjusting piston 2, coupled to the roller race, not shown, via the bolt 6 is disposed, is connected via a line 8 to the pressure fluid inflow line 15 and the pressure fluid outflow line 16. Once again, the 2/2-way magnet valve 34 is located in the pressure fluid inflow line 15, and the 2/2-way magnet valve 18 is located in the pressure fluid outflow line 16. For detecting the pressure in the pump work chamber or in the work chamber 7 that also represents this pressure, a pressure sensor 35 is provided, which is connected symbolically in FIG. 7 with the line 8 and on the other hand communicates with a control device, not shown, by way of which, as a function of operating parameters as in the exemplary embodiment of FIG. 5, the magnet valves 18 and 34 are controlled so as to control the desired pressure in the work chamber 7 for establishing the supply onset. In this way, regulation for the pressure course in the pump work chamber is created here, and the opening phase of the magnet valve 18 is shifted for the sake of fuel withdrawal during the high-pressure supply stroke of the pump piston, as shown in FIG. 8*a*, to the constructionally dictated high-pressure pumping phase of the pump piston, and specifically are shifted so far that the element pressure in the pump work chamber or in the work chamber 7 has dropped to the predetermined limit line P1 as shown in the diagram of FIG. 8*b*. In that case, the check valve 33 of the exemplary embodiment of FIG. 5 is omitted.

Finally, it is also conceivable to provide regulation of the injection duration via the withdrawal of fuel from the work chamber 7, in order to provide indirect regulation of the maximum attainable pressure in the pump work chamber. This is especially economical if a sensor, measuring the needle stroke of the injection valve, for instance, is present anyway on the injection valve to regulate the supply onset via the magnet valves 34 and 18, and in that case this sensor also measures the injection duration.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. An improved fuel injection pump for internal combustion engines, having a pump piston in a pump cylinder driven by a cam drive and the pump cylinder encloses a pump work chamber, from which upon the pumping stroke of the pump piston, fuel is pumped at high pressure to a fuel injection valve, said cam drive has a substantially stationary part and a mixing part driven by a drive shaft of the injection pump, one part of which is provided with a cam race and whose moving part, following the cam race, simultaneously moves the pump piston, by means of which a repelling force is exerted upon the substantially stationary part via the cam race, and an adjusting piston that encloses an adjusting work chamber in a cylinder, said adjusting work chamber is supplied with pressure fluid from a pressure fluid source, and by means of the pressure fluid is coupled adjustably to the substantially stationary part of the cam drive counter to a restoring force (3), wherein the repelling force is in the same direction as the restoring force and by adjustment of said adjusting piston adjusts the high-pressure supply stroke onset of the pump piston with respect to a rotary position of the drive shaft, and the pressure fluid pressure in the work chamber is controlled as a function of engine operating parameters in order to vary the supply stroke onset, and having a withdrawal device for the controlled withdrawal of quantities of pressure fluid from the work chamber during the high-pressure pumping stroke of the pump piston, said withdrawal device includes the adjusting work chamber (7) connected with a pressure fluid inflow line (15) containing a flow control device (17, 34) leading from the pressure fluid source and a pressure fluid outflow line (16), having an electrically controlled relief valve (18), to a relief chamber, by means of said flow control device, the pressure in the adjusting work chamber (7) is controlled, in order to vary the applicable supply stroke onset, in such a way that this pressure is established in each case prior to the onset of each pump piston supply stroke, and that the withdrawal of pressure fluid is controlled by the withdrawal device as a function of the pressure in the adjusting work chamber, or the pressure in the pump work chamber that influences the supply pressure during the high-pressure pumping stroke.

2. A fuel injection pump as defined by claim 1, in which the withdrawal device comprises a pressure holding valve (33) that communicates continuously with the adjusting work chamber (7) and by an opening pressure, the course of pressure in the adjusting work chamber or in the pump work chamber during the high-pressure pumping stroke of the pump piston is determined.

3. A fuel injection pump as defined by claim 1, in which the withdrawal device has a movable wall (11), which hydraulically borders the adjusting work chamber (7) and is acted upon on a back side by a prestressed spring (12), which is adjusted such that beyond a certain pressure in the adjusting work chamber or pump work chamber, the movable wall is adjusted.

4. A fuel injection pump as defined by claim 3, in which a travel limiting stop (17) for the motion of the movable wall counter to the force of the prestressed spring (12) is provided on the back side of the movable wall (11), and the certain pressure is located in a middle range of the pressure attainable by the pump piston over the operating range of the fuel injection pump during its respective supply stroke.

5. A fuel injection pump as defined by claim 3, in which the prestressed spring is supported in stationary fashion on the pump housing.

6. A fuel injection pump as defined by claim 1, in which the control device in the pressure fluid supply line is a check valve, which opens in a direction of the adjusting work chamber (7).

7. A fuel injection pump as defined by claim 2, in which the control device in the pressure fluid supply line is a check valve, which opens in a direction of the adjusting work chamber (7).

8. A fuel injection pump as defined by claim 3, in which the control device in the pressure fluid supply line is a check valve, which opens in a direction of the adjusting work chamber (7).

9. A fuel injection pump as defined by claim 4, in which the control device in the pressure fluid supply line is a check valve, which opens in a direction of the adjusting work chamber (7).

10. A fuel injection pump as defined by claim 1, in which a relief valve (18) acts as a withdrawal device and is opened as a function of operating parameters during at least a portion of the supply stroke of the pump piston.

11. A fuel injection pump as defined by claim 10, in which the relief valve (18) is opened as a function of the pressure attained in the pump work chamber from the time that a predetermined pressure is exceeded.

12. A fuel injection pump as defined by claim 10, in which the relief valve is controlled by an injection duration control, and the injection duration is measured by a sensor that detects the opening duration of an injection valve supplied by the injection pump.

13. A fuel injection pump as defined by claim 1, in which the control device in the pressure fluid inflow line is an electrically controlled inflow valve (34).

14. A fuel injection pump as defined by claim 2, in which the control device in the pressure fluid inflow line is an electrically controlled inflow valve (34).

15. A fuel injection pump as defined by claim 10, in which the control device in the pressure fluid inflow line is an electrically controlled inflow valve (34).

16. A fuel injection pump as defined by claim 11, in which the control device in the pressure fluid inflow line is an electrically controlled inflow valve (34).

17. A fuel injection pump as defined by claim 12, in which the control device in the pressure fluid inflow line is an electrically controlled inflow valve (34).

18. A fuel injection pump as defined by claim 13, in which between the operating times in which the pump piston executes its supply stroke, the relief valve and the inflow valve (34) are triggered in clocked fashion, in order to vary the pressure in the work chamber that controls the setting of the particular supply stroke onset desired.

19. A fuel injection pump as defined by claim 14, in which between the operating times in which the pump piston executes its supply stroke, the relief valve and the inflow valve (34) are triggered in clocked fashion, in order to vary the pressure in the work chamber that controls the setting of the particular supply stroke onset desired.

20. A fuel injection pump as defined by claim 15, in which between the operating times in which the pump piston executes its supply stroke, the relief valve and the inflow valve (34) are triggered in clocked fashion, in order to vary the pressure in the work chamber that controls the setting of the particular supply stroke onset desired.

* * * * *